United States Patent [19]

Carter

[11] Patent Number: 4,486,869

[45] Date of Patent: Dec. 4, 1984

[54] UNDERWATER ACOUSTIC DEVICES

[75] Inventor: Cecil G. Carter, Farnham, England

[73] Assignee: The Secretary of State for Defence in Her Britannic Majesty's Government of the United Kingdom of Great Britain and Northern Ireland, London, England

[21] Appl. No.: 347,767

[22] Filed: Feb. 11, 1982

[30] Foreign Application Priority Data

Feb. 25, 1981 [GB] United Kingdom ..... 8105960

[51] Int. Cl.[3] ..... H04R 17/00

[52] U.S. Cl. ..... 367/154; 310/800; 367/155

[58] Field of Search ..... 367/154, 155, 164, 166, 367/167, 153; 310/800

[56] References Cited

U.S. PATENT DOCUMENTS

| | | | |
|---|---|---|---|
| 3,286,227 | 11/1966 | Aldrich | 367/154 |
| 3,418,624 | 12/1968 | Massa | 367/154 |
| 3,444,511 | 5/1969 | Morrow | 367/153 |
| 4,183,010 | 1/1980 | Miller | 367/154 |
| 4,376,302 | 3/1983 | Miller | 367/157 |

FOREIGN PATENT DOCUMENTS

| | | | |
|---|---|---|---|
| 55-42474 | 3/1980 | Japan | 310/800 |

*Primary Examiner*—Richard A. Farley

*Attorney, Agent, or Firm*—Pollock, Vande Sande and Priddy

[57] ABSTRACT

The invention relates to underwater acoustic devices and arrays formed from such devices, and which in use are suspended in water from a buoy as other flotation equipment. An underwater device in accordance with the invention comprises an elongate tubular structure which is preferably suspended from a buoy having an aerial mounted on the buoy and connected to a radio transceiver housed within the buoy, wherein the tubular structure includes a plurality of transducer elements spaced apart along a common axis, preferably by spacer tubers wherein each of the transducer elements comprises a tube, or part of a tube, composed of a piezoelectric material, preferably polyvinylidene fluoride, and electrical terminal means contacting inner and outer curved surfaces of each tubular element.

4 Claims, 5 Drawing Figures

UNDERWATER ACOUSTIC DEVICES

The present invention relates to underwater acoustic devices and arrays formed from such devices. The invention particularly, though not exclusively, relates to acoustic devices, and arrays of such devices, which, in use, are suspended in water from a buoy or other flotation equipment.

Known underwater acoustic devices or sound transducers employ eithe a slab of piezoelectric material, a ferroelectric ceramic or a moving coil as their active element. Several such prior art transducers are described in U.S. Naval Research Laboratory Report NRL 7735 entitled "Twenty Years of Underwater Electroacoustic Standards" dated Feb. 21, 1974.

In addition, many prior art transducers intended for underwater operation tend to be bulky and some have excessively high power input requirements, and are not suitable for use as elements of a multitransducer array.

According to the present invention an underwater acoustic device comprises an elongate tubular structure which includes a plurality of tubular transducer elements spaced apart along a common axis, wherein each of the transducer elements comprises a tube, or part of a tube, composed of piezoelectric material, and electrical terminal means contacting inner and outer curved surfaces of each tubular element.

The structure may include spacer tubes located on the common axis, wherein adjacent transducer elements are separated by one of said spacer tubes. Alternatively the structure may comprise a single tube of piezoelectric material wherein the terminal means are arranged to contact longitudinally spaced portions of the tube, the portions comprising the transducer elements.

Each of the transducer elements may carry an internal support member located within the tube to prevent inward collapse of the tube when immersed in water. The elements are preferably gas pressurized.

Said piezoelectric material is preferably polyvinylidene fluoride.

The device may further include cable means attached to one end of the tubular structure for downwardly suspending or towing the structure in water.

Accroding to another aspect of the invention an underwater acoustic array comprises a plurality of said elongate tubular structures, and support means for holding the tubular structures with the longitudinal axes thereof parallel to form a cylindrical cage.

Embodiments of the invention will now be described by way of example only with reference to the drawings of which:

Figure 1:
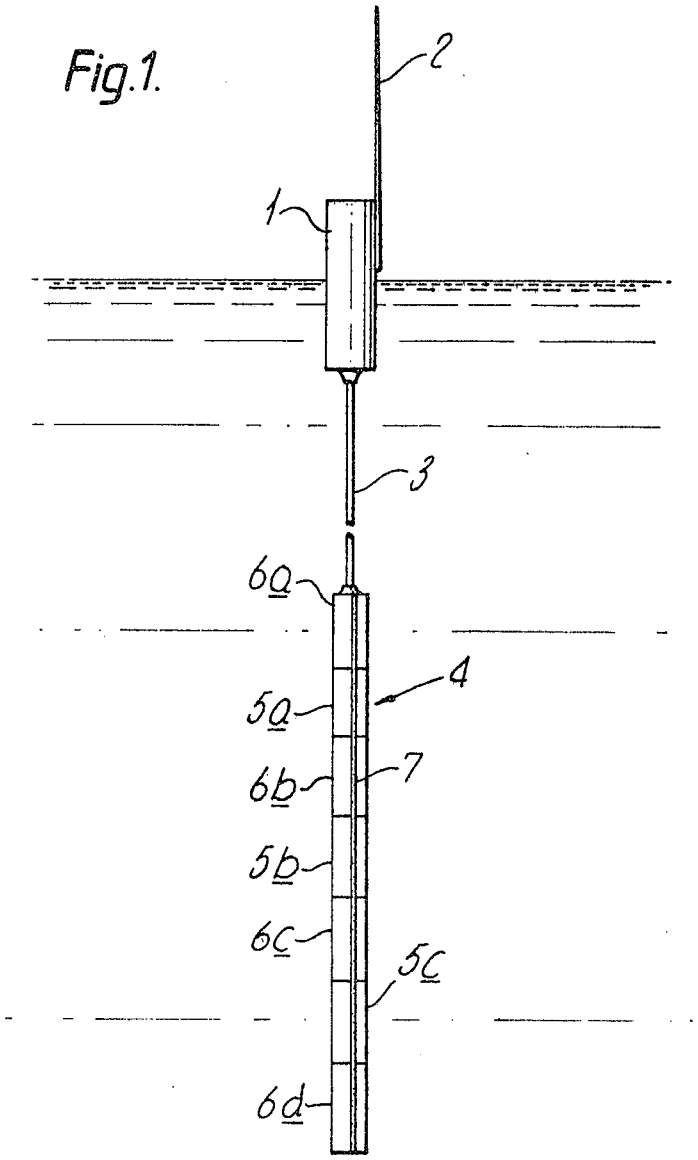
FIG. 1 is a schematic side view of an acoustic device in accordance with the invention.

The device shown in FIG. 1 includes a buoy 1 having an aerial 2 mounted on the side of the buoy and connected to a radio transceiver (not shown) which is housed within the buoy, and includes an elongate tubular assembly 4 which includes three stacked sound transducers 5*a*, 5*b*, 5*c*, suspended by a cable 3 from the buoy 1. The cable 3 includes wires which connect each of the sound transducers 5*a* to 5*c* to the transceiver in the buoy 1. The sound transducers 5*a*, 5*b*, 5*c*, are spaced on acommon axis alternately with spacer tubes 6*a* to 6*d*.

Figure 2:
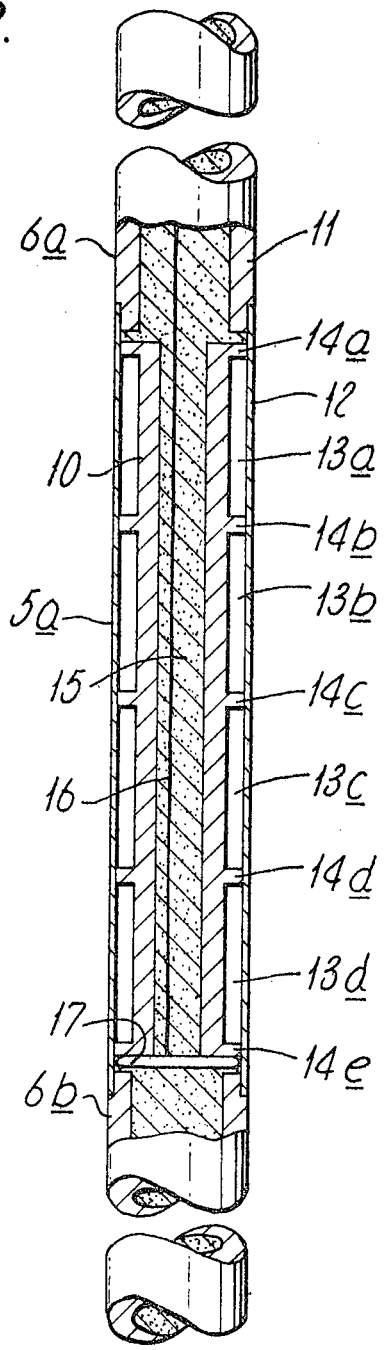
FIG. 2 is a sectional side view of part of the device of FIG. 1.

FIG. 2 shows details of the transducer 5*a* and adjacent spacers 6*a* and 6*b*. The transducers 5*a* to 5*c* each include a tube 12 composed of polyvinylidene fluoride, (PVDF), having a wall thickness of 0.45 mm and an outer diameter of 2 cm. The tube 12 is supported by a former 10 composed of polytetrafluoroethylene, (PTFE), of generally tubular configuration and has a set of five integral, circumferentially extending ribs 14*a* to 14*e* which abut the inner surface of the tube 12 and form annular air filled chambers 13*a* to 13*d*. The former 10 prevents collapse of the tube 12 when immersed at substantial depths without degrading the tube's performance as hydrophone. The tube 12 is air filled so that external pressures create high circumferential stresses in the tube to given high piezoelectrical output compared with for example a water filled tube of the same construction. The spacers 6*a* to 6*d* each comprise a rigid tube 11 of methyl methacrylate of which each end extends into and is bonded to an end portion of an adjacent tube 12.

PVDF is a commercially available polymer which is used for a variety of purposes, particularly in the chemical industry where its extreme inertness to chemical attack is of value. Piezoelectric and pyroelectric properties can be induced in PVDF by stretching for an example a rod or tube of PVDF, and electrically polarizing the stretched rod or tube. The table below gives typical properties of piezoelectric PVDF and a conventional piezoelectric ceramic.

TABLE 1

| Property | PVDF | Piezoelectric ceramic | Units |
|---|---|---|---|
| Relative dielectric constant | 13 | 1300 | — |
| Piezoelectric stress constant | 200 | 11.1 | $10^{-3}$Vm/N |
| Piezoelectric strain constant | 23 | 123 | $10^{-12}$M/V |
| Density | 1.8 | 7.5 | $10^3$kg/m$^3$ |
| Young's modulus | 3.03 | 83 | N/m$^2$ |

The tubes 12 are polarized when stretched in the longitudinal direction.

Each of the tubes 12 is provided with electrical contacts comprising a beryllium copper spring 17 which resiliently contacts the inner curved surface of the tube 12, and a layer 7 of high electrical conductivity paint which extends along the outer surfaces of the assembled transducers 5 and spacers 6 to form a common line for the transmission of electrical signals. The electrical contact 17 is connected by a wire 16 which extends along the interior of the assembly to a terminal box (not shown) to which wires of the cable 3 are connected. The other transducers 5*b* and 5*c* each have spring contacts and connecting wire corresponding to contact 17 and wire 16, and are connected thereby to the cable terminal box. The interiors of the tube 11 and 12 are filled with epoxy resin 15. The materials from which the assembly 4 is constructed were selected to give the assembly the same sound transmission characteristics as water.

In operation, when the acoustic device shown in FIGS. 1 and 2 is immersed in water and used in the passive mode i.e.: as a receiving hydrophone assembly, the transducer produces a piezoelectric signal for transmission via the cable 3 from the transceiver in the buoy 1. By varying the lengths of the transducer tubes 12 and the lengths of the spacer tubes 6 the response of the device to sound emanating from a particular direction relative to the assembly 4 can be changed, and signal/-noise ratio improved.

Figure 3:
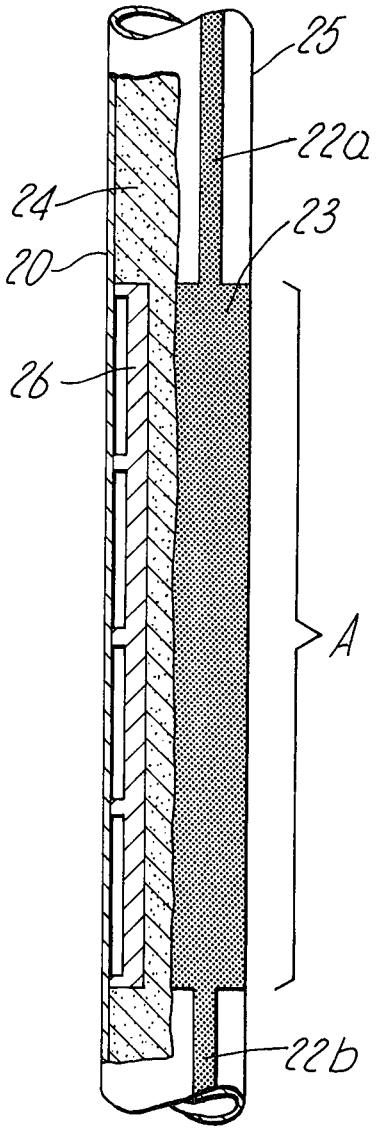
FIG. 3 is a part sectional side view of part of a further acoustic device in accordance with the invention.

FIG. 3 shows part of a further acoustic device which includes a tubular transducer assembly 25 of simpler construction than that described above. The assembly 25 comprises a single PVDF tube 20 of which three sound transducers are an integral part. One of the transducers is shown in detail in FIG. 3. A layer of high conductivity paint 23 extends over the outer curved surface of a center portion, A, of the tube 20 shown in FIG. 3, and a similar layer of paint (not shown) extends over the inner surface of the center portion, A, of the tube 20, to form a sound transducer having paint layer contacts. The transducer has a ribbed tubular former 26, composed of PTFE, which is similar to that shown in FIG. 2. The remaining two transducers (not shown) are similar to the transducer shown in FIG. 3. Electrical signals are transmitted to and from the transducers via lines comprising strips of conductive paint 22*a* and 22*b* which extend along the outer surface of tube 20 and corresponding strips (not shown) which extend along the inner surface of the tube 20 so that the three transducers are connected in parallel. The interior of the tube 20 is filled with epoxy resin 24.

Operation of the device, part of which is shown in FIG. 3, is generally as described for the previous embodiment of FIGS. 1 and 2, but assembly of the device of FIG. 3 is greatly simplified. The formers 26 are pushed into the tube 20 bearing the paint layer contacts and located at the transducer positions, and the epoxy resin 24 poured into the tube to form a rigid structure when the resin hardens. As shown in FIG. 3, the rigid structure formed by hardened resin 24 has cylindrical outer walls which abut the inner wall of tube 20 at intervals therealong to divide tube 20 into a plurality of chambers one of which is designated by the bracket A.

Figure 4:
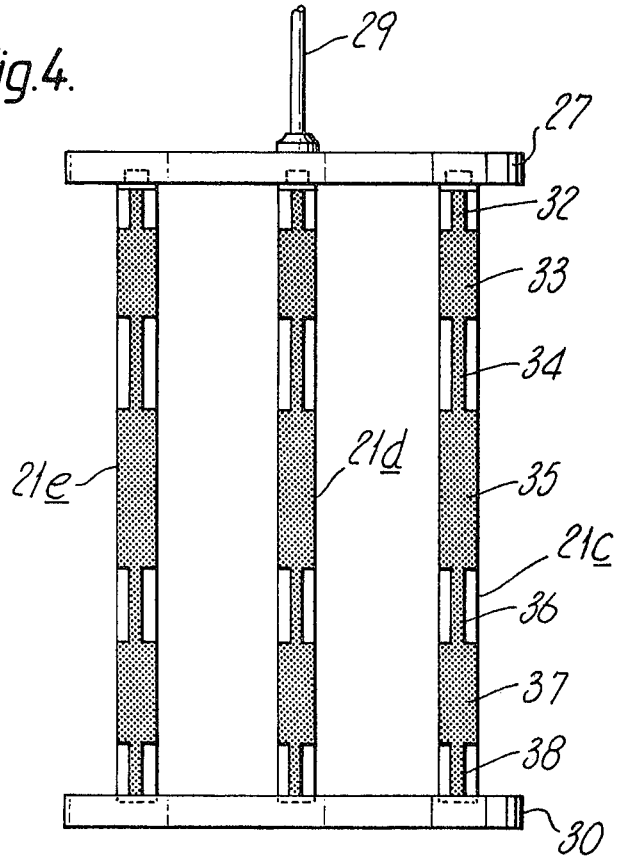
FIG. 4 is a side view of an acoustic array in accordance with the invention.
Figure 5:
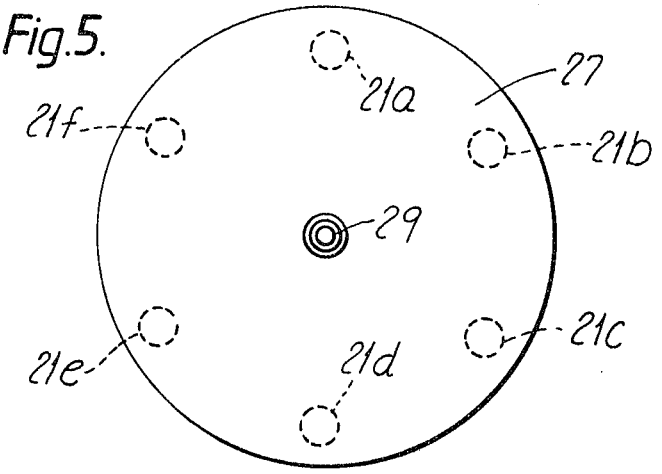
FIG. 5 is a plan view of the array of FIG. 4.

The acoustic array shown in FIGS. 4 and 5 comprises a set of six identical assemblies 21*a* to 21*f* each of which is similar to the device shown in FIG. 3 and includes three piezoelectric transducers. Referring to assembly 21*c* by way of example, the assembly has external electrically conductive paint layers 32 to 38, of which layers 33, 35 and 37 extend aroung their respective transducers and layers 32, 34, 36 and 38 form electrical connection lines between the transducers and a terminal box (not shown) connected to a line in a cable 29. Conductive paint layers (not shown) of the same configuration as the external layers are provided on the inside of the tube of the assembly 21*c* and are connected to a second line in cable 29 via the terminal box. The tubular assemblies 21*a* to 21*f* are disposed in a cylindrical array between upper and lower discshaped support members 27 and 30 respectively. The ends of each of the tubular assemblies 21*a* to 21*f* extend into and are bonded to the support members to form a rigid structure. The tubular assemblies are equally spaced on a circle of diameter equal to approximately one half wavelength at the acoustic center frequency of the buoy. Each of the tubular assemblies has a uniform response in aximuth with a vertical beamwidth of about 28°. Horizontal beams are formed by combining the stave outputs to produce six horizontal beams each of about 60° beamwidth.

Experiments with assemblies of PVDF, air filled tubes 30 cm long without spacers suggested that the scattering effects of the air filled tubes were such that such an array would not be sufficiently acoustically transparent and that the beam-forming capability would be reduced. By dividing the 30 cms tube into three sections using rigid spacers the acoustic impedance of the tube was brought closer to that of seawater.

I claim:

1. An underwater acoustic device including a tube composed of polymeric piezoelectric material having a high piezoelectric stress constant and a low Young's modulus, rigid means having cylindrical outer walls abutting the inner wall of said tube at intervals therealong for dividing said tube into a plurality of chambers, and sets of electrical terminal means contacting inner and outer curved surfaces of said tube at each chamber wherein each of said sets of electrical terminal means is associated with one of said chambers to define a plurality of tubular transducer elements.

2. An underwater acoustic device as claimed in claim 1 further comprising an internal support member located within each of said chambers to prevent inward collapse thereof when immersed in water.

3. An underwater acoustic device as claimed in claim 2 wherein each of said tubular transducer elements forms part of a gas-containing envelope, said elements being gas pressurized.

4. An underwater acoustic device as claimed in claim 1 wherein said piezoelectric material is polyvinylidene fluoride.

* * * * *